United States Patent [19]

Shibuya

[11] Patent Number: 4,543,049

[45] Date of Patent: Sep. 24, 1985

[54] VANE COMPRESSOR WITH MEANS FOR OBTAINING SUFFICIENT BACK PRESSURE UPON VANES AT THE START OF COMPRESSOR

[75] Inventor: Tsunenori Shibuya, Saitama, Japan

[73] Assignee: Diesel Kiki Co., Ltd., Tokyo, Japan

[21] Appl. No.: 666,968

[22] Filed: Oct. 31, 1984

[30] Foreign Application Priority Data

Nov. 4, 1983 [JP] Japan ..... 58-207238

[51] Int. Cl.[4] ..... F04C 18/00; F04C 29/10

[52] U.S. Cl. ..... 418/269

[58] Field of Search ..... 418/268, 269, 82; 417/299

[56] References Cited

U.S. PATENT DOCUMENTS

| | | | |
|---|---|---|---|
| 3,086,475 | 4/1963 | Rosaen | 418/268 |
| 3,762,843 | 10/1973 | Suzuki et al. | 418/82 X |
| 4,248,575 | 2/1981 | Watanabe et al. | 418/269 X |
| 4,447,196 | 5/1984 | Nagasaku et al. | 418/268 X |
| 4,484,868 | 11/1984 | Shibuya et al. | 418/268 X |

*Primary Examiner*—Richard E. Gluck

*Attorney, Agent, or Firm*—Frishauf, Holtz, Goodman & Woodward

[57] ABSTRACT

Front and rear radial roller bearings are provided in front and rear side blocks of the pump housing. A partition wall member is secured to an end face of the rear side block remote from the rotor to define a sealing chamber therebetween. The sealing chamber communicates with a back pressure chamber in the rotor through the rear radial roller bearing. A shaft-seal chamber defined between the front head and the front side block communicates with the back pressure chamber through the front radial roller bearing. The pump housing is formed therein with passage means communicating the discharge pressure chamber with at least one of the sealing chamber and the shaft-seal chamber. The passage means has valve means arranged therein, which is operable to open when the difference in pressure between the discharge pressure chamber and the back pressure chamber is below a predetermined value and to close when the pressure difference is above the latter, to thereby establish and interrupt communication between the discharge pressure chamber and at least one of the sealing chamber and the shaft-seal chamber.

5 Claims, 4 Drawing Figures

VANE COMPRESSOR WITH MEANS FOR OBTAINING SUFFICIENT BACK PRESSURE UPON VANES AT THE START OF COMPRESSOR

BACKGROUND OF THE INVENTION

This invention relates to vane compressors adapted for use with automotive air conditioning systems, and more particularly to a vane compressor of this kind, which is adapted to obtain sufficient back pressure acting upon the vanes to thereby enhance the degree of contact of the vanes with the camming surface at the start thereof.

Vane compressors are widely employed as refrigerant compressors in air conditioning systems for automotive vehicles by virtue of their structural simplicity and high adaptability to high rotational speed operation. Conventional vane compressors of this kind include a type including a pump housing having an endless inner peripheral camming surface, a rotor having a plurality of slits formed in its outer peripheral surface and a back pressure chamber formed in its interior and communicating with inner ends of the slits, and a rotary shaft drivingly supporting the rotor rigidly fitted thereon, wherein the rotary shaft extends in an airtight manner through a shaft-seal chamber formed in a front head forming part of a compressor casing accommodating the pump housing. In such type compressor, vanes slidably fitted in the slits of the rotor are revolved while in sliding contact with the endless camming surface of the pump housing, to vary the internal volumes of pump working chambers defined by inner surfaces of the pump housing including the camming surface, the outer peripheral surface of the rotor and adjacent vanes for suction and compression of refrigerant gas and discharge of same into a discharge pressure chamber defined between the compressor casing and the pump housing. To ensure achieving required efficiency of suction and compression in such type vane compressor, it is a requisite that the vanes should always be kept in close sliding contact with the camming surface of the pump housing during operation of the compressor. The force for causing close sliding contact of the vanes with the camming surface comprises centrifugal force produced by rotation of the rotor and acting upon the vanes, and internal pressure in the back pressure chamber acting upon the inner ends of the vanes as back pressure. The back pressure is given by compressed refrigerant gas under high pressure flowing from pump working chambers on compression stroke into the back pressure chamber through clearances between the vanes and the slits, clearances between the rotor and vanes and the inner end walls of the pump housing, etc. However, after the compressor has been stopped for a long time, it can often happen that part of the vanes in slits located at an upper half portion of the rotor are receded toward the diametrically center of the rotor with their tips off the inner peripheral camming surface of the pump housing due to their own weights. On the other hand, at or immediately after the start of the compressor, the centrifugal force acting upon the vanes and the pressure of the compressed refrigerant in the pump working chambers are not increased to such levels that the back pressure in the back pressure chamber can urgingly displace the vanes in the radially outward direction into smooth sliding contact with the inner peripheral camming surface of the pump housing, through expansion in the effective internal volume of the back pressure chamber. As a consequence, for some time after the start of the compressor and until the pressure of the compressed refrigerant increases to a required level, the vanes are repeatedly alternately brought into and out of contact with the camming surface to make a percussive noise, often causing damage to the vanes and the pump housing.

Further, in order to lubricate a shaft-sealing portion for sealing the rotary shaft, the compressor of the above described type is constructed such that the shaft-seal chamber accommodating a shaft-seal means is supplied with part of compressed gas with lubricating oil entrained therein from the back pressure chamber through a radial bearing supporting the rotary shaft. However, when the compressor is at rest, the high pressure compressed gas stays in the shaft-seal chamber, causing leakage of refrigerant gas and lubricating oil to the outside of the compressor.

In an attempt to overcome the unsmoothness of radially outward movement of the vanes at the start of the compressor, a compressor has been proposed, e.g. by Japanese Provisional Patent Publication No. 56-107992, in which an inner end face of at least one of the opposite end walls of the pump housing facing cylinder chambers (pump working chambers) is formed therein with two oil grooves communicating with bottom portions of the vane slits forming the back pressure chamber and also communicating with a discharge passage chamber (discharge pressure chamber), respectively, via a communication hole with a restriction provided therein and via a communication hole with a valve provided therein which is adapted to open the hole when the difference in pressure between the discharge passage chamber and the corresponding oil groove is below a predetermined value and to close when the former exceeds the latter, thereby supplying the refrigerant gas from the discharge passage chamber to the bottom portions of the vane slits through the communication holes and the oil grooves to obtain smooth radially outward movement of the vanes at the start of the compressor. However, this proposed compressor has the disadvantages that one of the oil grooves should have a complicated configuration and the restriction of one of the communication holes should have a very small diameter, thus requiring complicate machining operation.

Besides, the conventional compressors have another disadvantage of poor supply of lubricating oil to radial bearings supporting the rotary shaft at the start of the compressor.

SUMMARY OF THE INVENTION

It is an object of the invention to provide a vane compressor which is capable of enhancing the degree of contact of the vanes with the camming surface at the start of the compressor, thereby realizing reduction of the operating noise, preventing damage to the component parts, and improving the efficiency of suction and compression.

It is a further object of the invention to provide a vane compressor which is capable of effecting sufficient lubrication of the radial bearings for the rotary shaft at the start of the compressor, as well as preventing leakage of refrigerant gas and lubricating oil to the outside of the shaft-seal chamber during stoppage of the compressor.

It is another object of the invention to provide a vane compressor which can employ general-purpose roller bearings sold on the market, as the roller bearings for supporting the rotary shaft, thereby permitting reduction of the manufacturing cost.

According to the invention, at least one radial roller bearing is arranged in a through hole axially formed in at least one of front and rear side blocks of a pump housing in which a rotor is rotatably fitted, to rotatably support the rotary shaft fitted in the through hole. Partition means cooperates with one end face of the at least one of the front and rear side blocks remote from the rotor to define a sealing chamber therebetween, into which opens the through hole. Communication means communicates the through hole with a back pressure chamber formed in the rotor. Passage means is formed in the pump housing and communicates the discharge pressure chamber of the compressor with the sealing chamber. Valve means is arranged in the passage means and operable to open at a value of the difference in pressure between the discharge pressure chamber and the back pressure chamber below a predetermined value to establish communication between the discharge pressure chamber and the sealing chamber, and to close at a value of the pressure difference above the predetermined value to interrupt the communication between the discharge pressure chamber and the sealing chamber.

The above and other objects, features and advantages of the invention will be more apparent from the ensuing detailed description taken in conjunction with the accompanying drawings.

DETAILED DESCRIPTION

Figure 1:
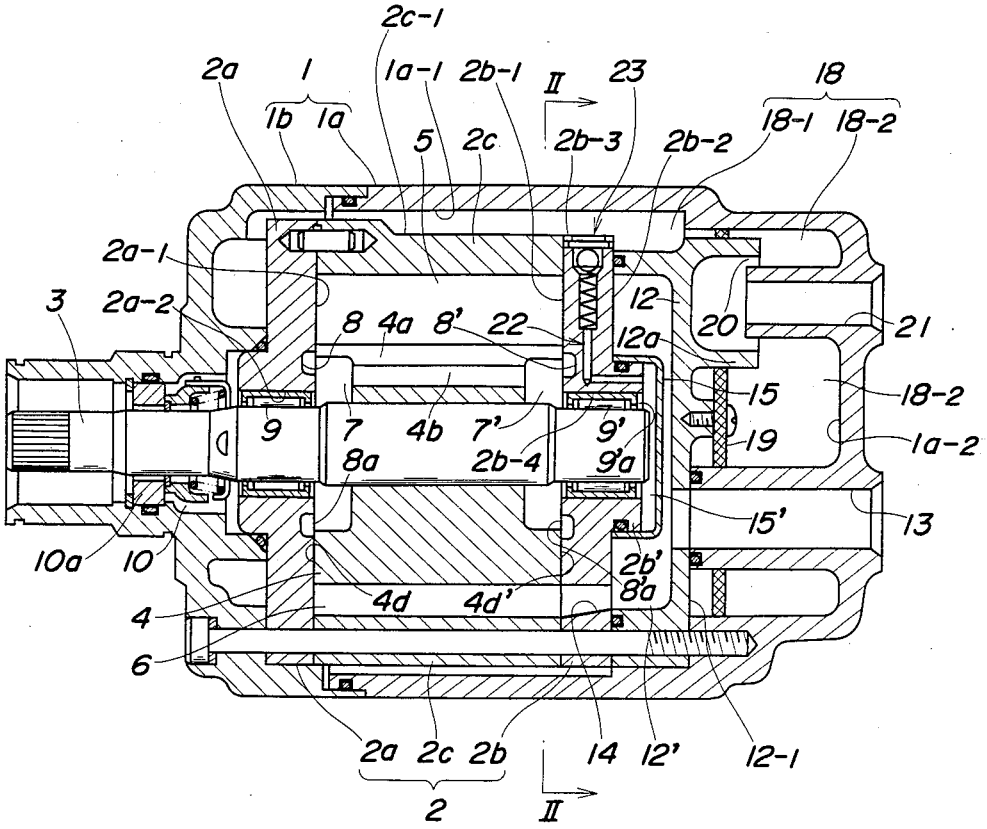
FIG. 1 is a longitudinal sectional view of a vane compressor according to an embodiment of the invention.

The invention will now be described in detail with reference to the drawings showing an embodiment thereof.

A cylindrical casing 1*a* has an open front end airtightly fitted to a front head 1*b* to define a compressor casing 1 in cooperation therewith. Accommodated within the compressor casing 1 is a pump housing 2 which is defined by front and rear side blocks 2*a* and 2*b*, and a cam ring 2*c* secured at opposite ends to the side blocks 2*a*, 2*b*. Rotatably fitted within the pump housing 2 is a cylindrical rotor 4 rigidly fitted on a rotary shaft 3 and carrying a plurality of plate-like vanes 5 radially slidably fitted in slits 4*a* formed in its outer peripheral surface 4*c* in circumferentially spaced arrangement. Thus, during rotation of the rotor 4, inner surfaces of the pump housing 2, the outer peripheral surface 4*c* of the rotor 4, and adjacent vanes 5 cooperate with each other to define pump working chambers 6 therebetween. Opposite end faces 4*d* and 4*d'* of the rotor 4 are formed with annular grooves 7, 7' which are disposed concentrically with the rotary shaft 3 and communicate with a back pressure chamber 4*b* formed within the rotor 4 in communication with radially inner ends of the slits 4*a*. On the other hand, the front and rear side blocks 2*a*, 2*b* have respective inner end faces 2*a*-1 and 2*b*-1 formed therein with annular oil grooves 8 and 8' which are disposed concentrically with the rotary shaft 3 or annular grooves 7, 7' and have open end faces 8*a* and 8'*a*, radially inner part of which open into the grooves 7, 7' and the other or radially outer part overlap with the opposed remaining end faces of the rotor 4 so as to guide refrigerant gas with lubricating oil entrained therein to the sliding surfaces end faces of the rotor 4 and the front and rear side blocks 2*a*, 2*b*.

The rotary shaft 3 extends through front and rear radial roller bearings 9 and 9' fitted in through holes 2*a*-2 and 2*b*-4 formed in the front and rear side blocks 2*a*, 2*b* in a manner rotatably supported by the roller bearings 9, 9', and also extends through a shaft-seal chamber 10 defined in the front head 1*b* by the same head 1*b*, the front side block 2*a* and shaft-sealing means 10*a* fitted in the front head 1*b*, in a manner airtightly sealed against the outside. A partition wall member 12 is fixed to an end face 2*b*-2 of the rear side block 2*b* remote from the rotor 4 to define a suction chamber 12' between itself and the rear side block 2*b*, which communicates, on one hand, with a suction port 13 formed through a rear wall of the compressor casing 1, and on the other hand, can communicate with pump working chambers 6 on suction stroke, through pump inlets 14 and 14 formed through the rear side block 2*b*. The rear side block 2*b* has a rearwardly extending central boss 2*b'* disposed concentrically with the through hole 2*b*-4 in the rear side block 2*b*, on which is airtightly fitted a cap-shaped partition wall member 15 as partition means in a manner defining a sealing chamber 15' between the side block 2*b* and itself. The sealing chamber 15' prevents compressed refrigerant gas supplied thereto from the back pressure chamber 4*b* through the annular groove 7' and the internal clearance of the roller bearing 9' from leaking into the suction chamber 12' under low pressure.

Figure 2:
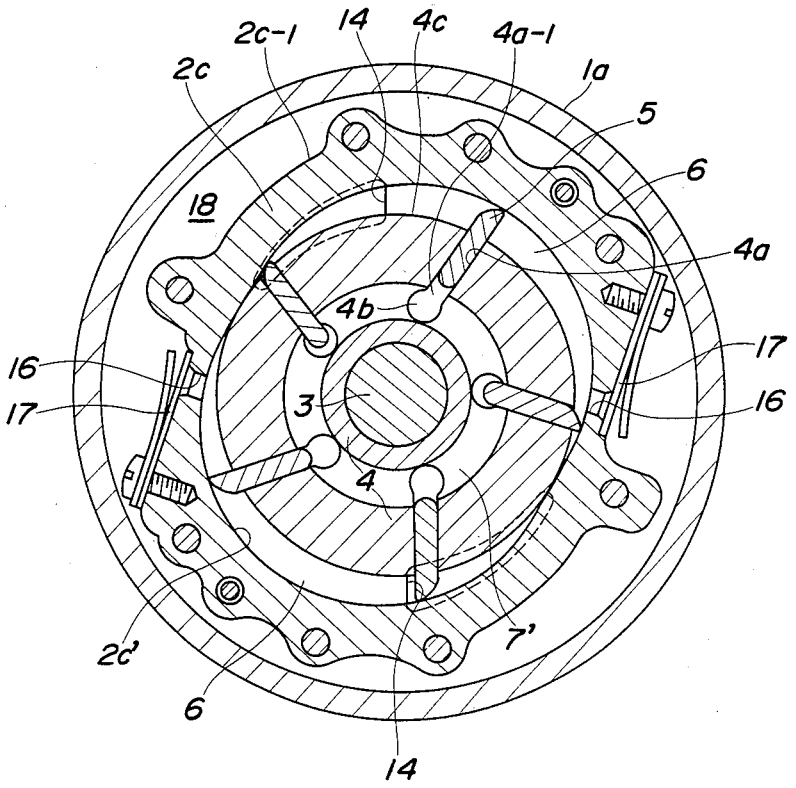
FIG. 2 is a transverse cross-sectional view taken along line II—II in FIG. 1.

As shown in FIG. 2, the cam ring 2*c* is formed therein with pump outlets 16 and 16 disposed to communicate with pump working chambers 6 on compression stroke, and carries discharge valves 17 and 17 secured to its outer peripheral surface and disposed over the pump outlets 16, 16. Thus, the discharge pressure chamber 18 can communicate with the pump working chambers 6 on compression stroke through the pump outlets 16, 16 and discharge valves 17, 17 when the latter are opened by the pressure of compressed refrigerant gas. The discharge pressure chamber 18 is formed by a first portion 18-1 and a second portion 18-2 communicating therewith through an oil separator 19 fitted on the partition wall member 12. The first portion 18-1 is defined between an inner peripheral wall of the cover 1*a* of the compressor casing 1 and outer peripheral surfaces 2*b*-3 and 2*c*-1 of the rear side block 2*b* and cam ring 2*c* along the whole periphery thereof, while the second portion 18-2 is defined between another inner peripheral surface of the cover 1*a* and a rear end face of the partition wall member 12. A discharge port 21 is formed through the rear wall of the cover 1*a* and inwardly extends therefrom, around which is disposed an annular projecting wall 22*a* to define an annular passage 20 between them to prevent pulsation of discharge refrigerant gas.

Figure 3:
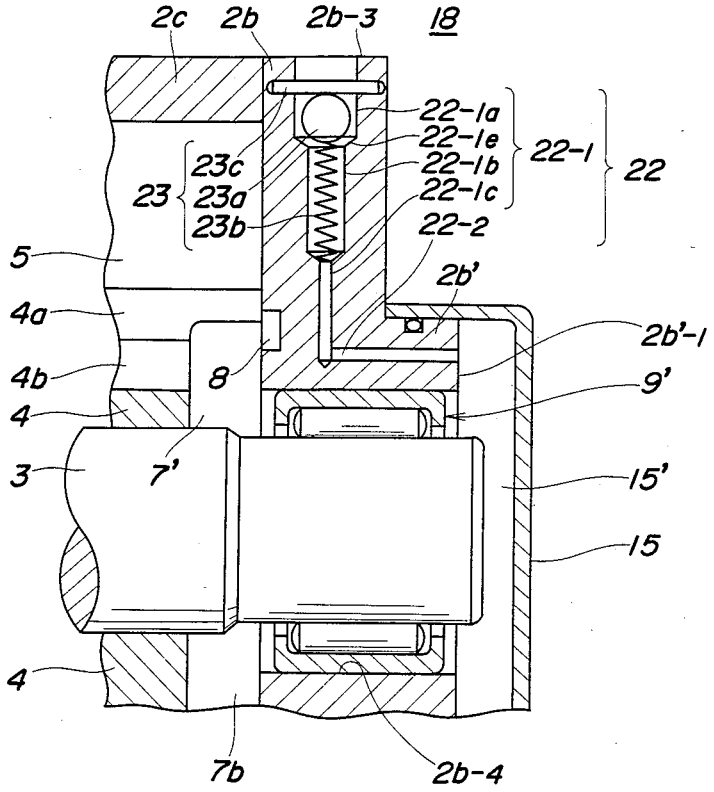
FIG. 3 is a fragmentary longitudinal sectional view, on an enlarged scale, of the compressor of FIG. 1, showing passage means, valve means, and their peripheral parts.

According to the invention, a communication passage 22 as passage means is formed in the rear side block 2*b* of the pump housing 2, which communicates the discharge pressure chamber 18 with the sealing chamber 15, through a check valve 23 arranged in the same passage 22. As best shown in FIG. 3, the communication passage 22 comprises a first passage 22-1 radially extending in the rear side block 2*b*, and a second passage 22-2 axially extending therein. The first passage 22-1 is formed of a stepped passage having a large-sized portion 22-1*a* terminating in the outer peripheral surface 2*b*-3 of the rear side block 2*b* and opening into the discharge pressure chamber 18, and in which is movably fitted a ball 23*a* as a valve body, a medium-sized portion 22-1*b* in which is accommodated a coil spring 23*b* urging the ball 23*a* toward the discharge pressure chamber 18, and a small-sized portion 22-1*c* downwardly extending from the portion 22-1*b*. The second passage 22-2 axially extends in the boss 2*b*' of the rear side block 2*b*, communicating at one end with the small-sized portion 22-1*c* of the first passage 22-1 and terminating at the other end in a rear end face 2*b*'-1 of the boss 2*b*' and opening into the sealing chamber 15'. The ball 23*a* is disposed to be seated on an annular tapered valve seat 22-1*e* formed at the junction between the large-sized portion 22-1*a* and the medium-sized portion 22-1*b*. The upper open end of the large-sized portion 22-1*a* is provided with a stopper pin 23*c* transversely fitted therein to prevent disengagement of the ball 23*a* from the communication passage 22-1. The setting load of the spring 23*b* of the check valve 23, which determines the valve opening pressure of the valve 23, is set such that the ball 23*a* is displaced into an open position by the force of the spring 23*b* when the difference Pd−Pv between the pressure Pd in the discharge pressure chamber 18 and the pressure Pv in the back pressure chamber 4*b* exceeds a predetermined value Pc.

The clearances between the slits 4*a* in the rotor 4 and the vanes 5, between the rotor and vanes and the front and rear side blocks 2*a*, 2*b*, etc. are set at such respective predetermined values as to maintain the pressure Pv in the back pressure chamber 4*b* acting upon the vanes 5 at a value substantially equal to an arithmetic mean value (Pd+Ps)/2 during steady operation of the compressor at a normal operating speed. For example, if the compressor speed is about 2300 rpm and then the discharge refrigerant gas pressure Pd is about 14 kg/cm$^2$ and the suction refrigerant gas pressure Ps about 2 kg/cm$^2$, respectively, the back pressure Pv will be about 8 kg/cm$^2$. During stoppage of the compressor, the temperature of residual refrigerant gas within the discharge pressure chamber 18 lowers to a value equal to the atmospheric air temperature due to heat exchange between the refrigerant gas within the chamber 18 and the atmospheric air so that the pressure within the chamber 18 drops to the saturation pressure P0 of refrigerant corresponding to the atomospheric air temperature (e.g. if the atmospheric air temperature is 25°–35° C., the pressure Pd will decrease to approximately 6.6–8.6 Kg/cm$^2$).

Figure 4:
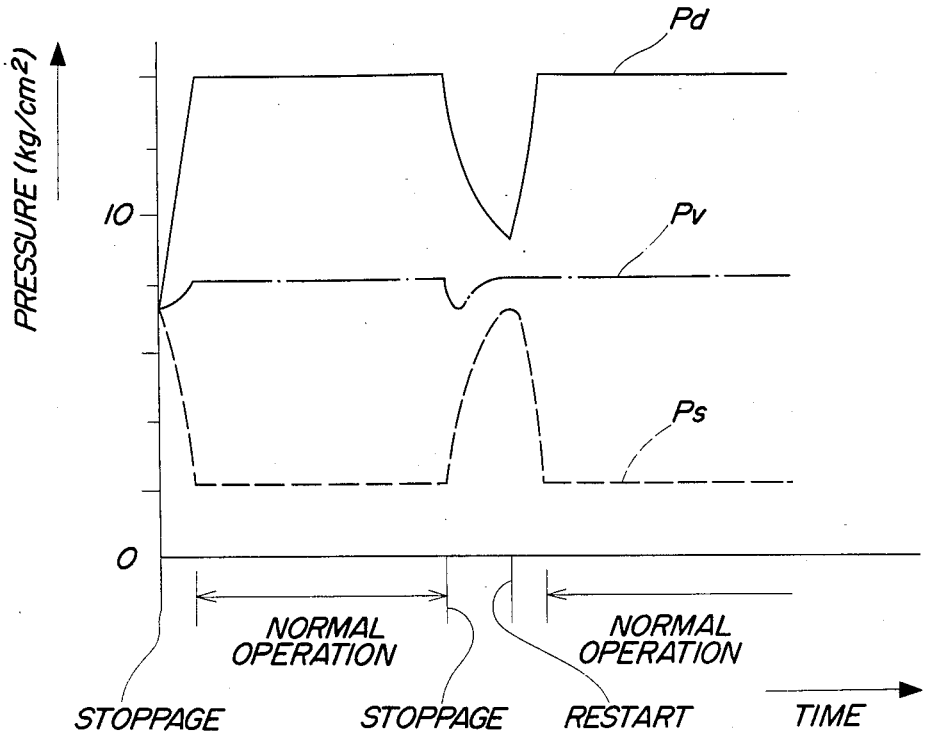
FIG. 4 is a graph showing variations in pressures in the discharge pressure chamber, suction chamber and back pressure chamber of the compressor, relative to the lapse of time, at stoppage, normal operation and restart of the compressor.

As is learned from the graph of FIG. 4, the decrease rate of the discharge pressure Pd is fairly large immediately after stoppage of the compressor whereas the rate of change of the back pressure Pv is small between during operation of the compressor and during stoppage thereof. Accordingly, although the discharge pressure Pd and the difference Pd−Pv assume large values immediately upon stoppage of the compressor, they rapidly decrease with the lapse of time after the stoppage of the compressor while the compressor remains inoperative. In view of this, if the predetermined value Pc determining the valve opening pressure of the vale 23 is set at a value equal to the difference Pd−Pv usually assumed after the lapse of a predetermined period of time (e.g. 30 seconds) from stoppage of the compressor, residual refrigerant gas within the discharge pressure chamber 18 is supplied to the back pressure chamber 4*b* only when the compressor is restarted after the lapse of the above predetermined period of time from stoppage of the compressor. In other words, if the compressor is restarted before the lapse of the same predetermined period of time, no supply of discharge refrigerant gas to the back pressure chamber 4*b* takes place, thereby avoiding the application of excessive urging force by the vanes 5 to the camming surface 2*c*' which would otherwise caused by the supply of high pressure discharge refrigerant gas to the chamber 4*b*. Furthermore, the provision of the above predetermined period of time enables supply of residual refrigerant gas under moderate or proper pressure to the back pressure chamber 4*b* after the lapse of the predetermined period of time after stoppage of the compressor, thereby ensuring smooth and positive sliding contact of the vanes 5 with the camming surface 2*c*'.

The operation of the vane compressor constructed as above will now be described.

During normal operation of the compressor, the vanes 5 are caused to revolve with their tips kept in sliding contact with the inner peripheral camming surface 2*c*' of the cam ring 2*c* in unison with rotation of the rotor 4 together with the rotating rotary shaft 3. During revolution of the vanes 5, the pump working chambers 6 expand in volume to draw refrigerant gas through the suction port 13, the suction chamber 12 and the pump inlets 14 during suction stroke thereof, contract in volume to compress the drawn refrigerant gas during compression stroke, and discharge the compressed gas into the discharge pressure chamber 18 through the pump outlets 16 and discharge valves 17 during discharge stroke. The refrigerant gas discharged into the chamber 18 is separated from lubricating oil entrained therein as it passes the oil separator 19 in the chamber 18, and then it is guided through the annular passage 20 to have its pulsation reduced, and then discharged into the external refrigerant circuit, not shown, through the discharge port 21.

After stoppage of the compressor for a long time, part of the vanes 5 located at an upper half portion of the rotor 4 can assume receded positions due to their own weights, with their tips off the inner peripheral camming surface 2*c*' of the cam ring 2*c*. On this occasion, the discharge pressure Pd and the back pressure Pv assume a value substially equal to the saturation pressure P0, and accordingly the difference Pd−Pv between them is nearly zero. If the compressor is started with part of the vanes in such receded positions, the difference Pd−Pv is smaller than the predetermined value Pc so long as the rotational speed of the compressor falls within a certain low range after the restart of the compressor. Consequently, the ball 23*a* of the check valve 23 in the communication passage 22 is lifted from the valve seat 22-1*e* toward the discharge pressure chamber 18 by the force of the spring 23*b* against the pressure within the discharge pressure chamber 18 to open the check valve 23, i.e. open the communication passage 22. This establishes communication of the back pressure chamber 4*b* within the rotor 4 with the discharge pressure chamber 18 through the rear annular groove 7', the internal clearance of the rear roller bearing 9', the sealing chamber 15', and the communication passage 22. Therefore, even at and immediately after the start of the compressor when the centrifugal force acting upon the vanes 5 is small and the back pressure chamber 4*b* is not supplied with an amount of compressed refrigerant gas sufficient to provide required back pressure from the pump working chambers 6 on compression stroke, the back pressure chamber 4*b* can be promptly supplied with an amount of refrigerant gas required to cause projection of the vanes 5 into close sliding contact with the camming surface 2*c*', from the discharge pressure chamber 18 through the communication passage 22, the sealing chamber 15', the rear roller bearing 9', and the rear annular groove 7'*b*. Since the back pressure chamber 4*b* and the discharge pressure chamber 18 are thus in communication with each other at the start of the compressor as noted above, when the compressor is started so that the vanes 5 are acted upon by centrifugal force produced by rotation of the rotor 4 to be displaced radially outward and accordingly the volume of the space within the rotor 4 defined by the radially inner ends of the vanes and the inner surfaces of the back pressure chamber 4*b* is about to increase, the vanes 5 are not acted upon by any force for causing them to recede radially inward, which would be produced by a drop in the pressure within the above space due to the volumetric increase of the space in the conventional arrangement wherein the back pressure chamber is closed or isolated from the discharge pressure chamber. Therefore, in the arrangement of the present invention, the vanes 5 can be quickly lifted by the centrifugal force immediately upon starting of the compressor to thereby promptly bring the compressor into a normal operative state.

Also if the stoppage of the compressor lasts not for a long time but for a time exceeding the aforementioned predetermined period of time by a little bit, the difference Pd−Pv is below the predetermined value Pc as noted before, then a similar valving action of the valve 23 takes place to that described above.

Further, the arrangement of the invention causes supply of lubricating oil together with refrigerant gas to the rear roller bearing 9' as well as to the front roller bearing 9 through the rear annular groove 7', the back pressure chamber 4*b*, and the front annular groove 7, and also causes supply of part of the lubricating oil supplied to the front roller bearing 9 to the shaft-seal chamber 10 through the internal clearance of the front roller bearing 9, at the start of the compressor. In addition, this supply of lubricating oil can take place immediately upon starting of the compressor to permit prompt lubrication of the front and rear roller bearings 9, 9', and the shaft sealing means 10*a* even after stoppage of the compressor over a long time when these parts are completely devoid of lubricating oil, thereby always ensuring adequate lubrication and cooling of these parts and positive sealing action of the shaft sealing means 10*a*.

When the difference between the discharge pressure Pd and the back pressure Pv increases above the predetermined value Pc with further operation of the compressor, the ball 23*a* of the check valve 23 is urgedly displaced by the increased pressure within the discharge pressure chamber 18 against the force of the spring 23*b*, into a position seated on the valve seat 22-1*e*, to thus close the check valve 23 or the communication passage 22. Thus, the supply of refrigerant gas from the discharge pressure chamber 18 to the back pressure chamber 4*b* is interrupted to avoid application of excessively high back pressure to the vanes 5 to thereby maintain proper pressure of contact of the vanes 5 with the with the camming surface 2*c*'.

When the compressor is stopped, the pressure of the residual refrigerant in the discharge pressure chamber 18 gradually drops down to the saturation pressure P0 of the refrigerant corresponding to the atmospheric air temperature, due to heat exchange between the refrigerant and the atmospheric air, that is, below the predetermined value Pc. Accordingly, the check vale 23 is again opened to open the communication passage 22 so that the shaft-seal chamber 10 communicates with the discharge pressure chamber 18 through the annular grooves 7, 7', the communication passage 22, etc. to allow escape of high pressure refrigerant gas from the shaft-seal chamber 10 to the discharge pressure chamber 18 larger in volume than the former. Thus, the internal pressure of the shaft-seal chamber 10 drops, thereby preventing leakage of refrigerant gas and lubricating oil to the outside through the shaft-sealing means 10*a*, during stoppage of the compressor.

Furthermore, the arrangement according to the invention makes it possible to employ general-purpose roller bearings sold on the market as the radial roller bearings 9, 9' without requiring any additional machining thereof, resulting in a low manufacturing cost.

Still further, the communication passage 22, the annular grooves 7, 7'; 8, 8', etc. forming the refrigerant gas passageway between the discharge pressure chamber 18, the back pressure chamber 4*b*, and the shaft-seal chamber 10 may be simple in configuration, facilitating the formation of them and even making it possible to convert a conventional vane compressor into a vane compressor with addition of small alterations thereto.

Although in the embodiment described above the valve means or check valve 23 is arranged in a radially extending portion of the passage means or communication passage 22 formed in the rear side block 2*b*, alternatively the passage means may include an axially extending portion opening into the discharge pressure chamber 18, in which the valve means 23 may be arranged. Anyhow, the arrangement of the invention permits use of a small-sized pump housing as the pump housing 2, thereby making the whole compressor compact in size.

Although in the described and illustrated embodiment the passage means 22 and the valve means 23 are provided in the rear side block 2*b* alone, they may be provided in one or both of the front and rear side blocks 2*a*, 2*b*, each in a similar arrangement to that of the embodiment. If the passage means and the valve means are provided in the front side block 2*a*, the passage means may include a communication passage terminating at one end in an end face of the front side block 2*a* remote from the rotor 4 and opening into the shaft-seal chamber 10, wherein the shaft-sealing means 10*a* and the inner walls of the front head 1*b* defining the shaft-seal chamber 10 serve as the partition means or partition wall member 15 and the shaft-seal chamber 10 as the sealing chamber 15', respectively.

While a preferred embodiment of the invention has been described, variations thereto will occur to those skilled in the art within the scope of the present inventive concepts which are delineated by the following claims.

What is claimed is:

1. A vane compressor comprising: a pump housing having an endless inner peripheral camming surface, said pump housing including a front side block and a rear side block disposed at opposite ends thereof, at least one of said front and rear side blocks having a through hole axially formed therein; a rotor rotatably fitted within said pump housing, said rotor having an outer peripheral surface formed therein with a plurality of slits, and defining therein a back pressure chamber communicating with said slits; a plurality of vanes slidably fitted in said slits of said rotor for sliding contact with said endless inner peripheral camming surface of said pump housing; a rotary shaft having a portion thereof disposed within said pump housing and drivingly supporting said rotor fitted thereon, said rotary shaft being fitted in said through hole of said at least one of said front and rear side blocks; a compressor casing accommodating said pump housing and cooperating therewith to define a discharge pressure chamber therebetween; at least one radial roller bearing arranged in said through hole of said at least one of said front and rear side blocks and rotatably supporting said rotary shaft fitted in said through hole; partition means cooperating with one end face of said at least one of said front and rear side blocks remote from said rotor to define a sealing chamber therebetween, said through hole opening into said sealing chamber; communication means communicating said through hole with said back pressure chamber in said rotor; passage means formed in said pump housing and communicating said discharge pressure chamber with said sealing chamber; and valve means arranged in said passage means and operable to open at a value of the difference in pressure between said discharge pressure chamber and said back pressure chamber below a predetermined value to establish communication between said discharge pressure chamber and said sealing chamber, and to close at a value of the difference in pressure above said predetermined value to interrupt the communication between said discharge pressure chamber and said sealing chamber.

2. A vane compressor as claimed in claim 1, wherein said passage means and said valve means are provided in said rear side block, said partition means comprising a partition wall member secured to one end face of said rear side block remote from said rotor and cooperating therewith to define said sealing chamber therebetween.

3. A vane compressor as claimed in claim 2, wherein said discharge pressure chamber extends at least along an outer peripheral surface of said rear side block, said passage means comprising a first passage extending in said rear side block radially thereof, said first passage having one end terminating in said outer peripheral surface of said rear side block and opening into said discharge pressure chamber, and a second passage extending in said rear side block axially thereof, said second passage having one end terminating in said one end face of said rear side block remote from said rotor and opening into said sealing chamber.

4. A vane compressor as claimed in claim 1, wherein said valve means comprises a ball as a valve body disposed in said passage means, a spring disposed in said passage means at a side of said ball remote from said discharge pressure chamber and urging said ball toward said discharge pressure chamber, and a valve seat formed in said passage means, on which is seatable said ball.

5. A vane compressor comprising: a pump housing having an endless inner peripheral camming surface, said pump housing including a front side block and a rear side block disposed at opposite ends thereof, said front and rear side blocks each having a through hole axially formed therein; a rotor rotatably fitted within said pump housing, said rotor having an outer peripheral surface formed therein with a plurality of slits, and defining therein a back pressure chamber communicating with said slits; a plurality of vanes slidably fitted in said slits of said rotor for sliding contact with said endless inner peripheral camming surface of said pump housing; a front head secured to said front side block and cooperating therewith to define a shaft-seal chamber therebetween; a rotary shaft having a portion thereof disposed within said pump housing and drivingly supporting said rotor fitted thereon, said rotary shaft extending through said shaft-seal chamber and being fitted in said through holes of said front and rear side blocks; a compressor casing accommodating said pump housing and cooperating therewith to define a discharge pressure chamber therebetween; a pair of radial roller bearings arranged in respective ones of said through holes of said front and rear side blocks and rotatably supporting said rotary shaft fitted in said through holes; partition means cooperating with one end face of said rear side block remote from said rotor to define a sealing chamber therebetween, one of said through holes formed in said rear side block opening into said sealing chamber, and the other of said through holes formed in said front side block opening into said shaft-seal chamber; communication means communicating said through holes with said back pressure chamber in said rotor; passage means formed in said pump housing and communicating said discharge pressure chamber with said sealing chamber; and valve means arranged in said passage means and operable to open at a value of the difference in pressure between said discharge pressure chamber and said back pressure chamber below a predetermined value to establish communication between said discharge pressure chamber and said sealing chamber, and to close at a value of the difference in pressure above said predetermined value to interrupt the communication between said discharge pressure chamber and said sealing chamber.

* * * * *